US010159286B2

(12) United States Patent
Holzherr

(10) Patent No.: US 10,159,286 B2
(45) Date of Patent: Dec. 25, 2018

(54) SYSTEM AND METHOD FOR CONFIGURING ELECTRICAL CONTACTS IN ELECTRICAL DEVICE

(71) Applicant: Philip Morris Products S.A., Neuchatel (CH)

(72) Inventor: Raphael Holzherr, Fontaines (CH)

(73) Assignee: Philip Morris Products S.A., Neuchatel (CH)

( * ) Notice: Subject to any disclaimer, the term of this patent is extended or adjusted under 35 U.S.C. 154(b) by 22 days.

(21) Appl. No.: 15/509,945

(22) PCT Filed: Oct. 13, 2015

(86) PCT No.: PCT/EP2015/073714
§ 371 (c)(1),
(2) Date: Mar. 9, 2017

(87) PCT Pub. No.: WO2016/059073
PCT Pub. Date: Apr. 21, 2016

(65) Prior Publication Data

US 2017/0338609 A1 Nov. 23, 2017

(30) Foreign Application Priority Data

Oct. 17, 2014 (EP) ..... 14189420

(51) Int. Cl.
*A24F 47/00* (2006.01)
*H01R 13/645* (2006.01)
(Continued)

(52) U.S. Cl.
CPC ..... *A24F 47/008* (2013.01); *H01R 13/6456* (2013.01); *H01R 29/00* (2013.01); *H01R 31/065* (2013.01)

(58) Field of Classification Search
CPC ..... A24F 47/008; H01R 13/065; H01R 29/00
See application file for complete search history.

(56) References Cited

U.S. PATENT DOCUMENTS 9,655,383 B2 * 5/2017 Holzherr ..... A24F 47/008
9,883,700 B2 * 2/2018 Holzherr ..... A24F 47/008
(Continued)

FOREIGN PATENT DOCUMENTS

WO WO 2013/102611 A2 7/2013
WO WO 2014/107157 A1 7/2014

OTHER PUBLICATIONS

International Search Report and Written Opinion dated Dec. 11, 2015 in PCT/EP2015/073714, filed Oct. 13, 2015.

*Primary Examiner* — James Harvey
(74) *Attorney, Agent, or Firm* — Oblon, McClelland, Maier & Neustadt, L.L.P.

(57) ABSTRACT

A system is provided, including a primary device and a secondary device, the primary device having electrical contact pins configured to engage electrical contacts on the secondary device to allow for the exchange of power and data between the devices; the primary device having n electrical contact pins, where n is a positive integer greater than two; the devices are constructed such that the pins of the primary device are engageable with the contacts of the secondary device in a plurality of m distinct electrical orientations, wherein m is a positive integer less than n; and the primary device is configured to determine which of the m orientations the secondary device is in relative to the primary device by comparing voltages measured between at least m different pairs of contacts with a voltage record stored in a memory in the primary device.

15 Claims, 6 Drawing Sheets

(51) Int. Cl.
*H01R 29/00* (2006.01)
*H01R 31/06* (2006.01)

(56) References Cited

U.S. PATENT DOCUMENTS

| | | | | |
|---|---|---|---|---|
| 2010/0080563 | A1 | 4/2010 | Difonzo et al. | |
| 2011/0038582 | A1 | 2/2011 | Difonzo et al. | |
| 2013/0115817 | A1 | 5/2013 | Terlizzi et al. | |
| 2013/0117470 | A1 | 5/2013 | Terlizzi et al. | |
| 2013/0170794 | A1 | 7/2013 | Difonzo et al. | |
| 2013/0244489 | A1 | 9/2013 | Terlizzi et al. | |
| 2014/0181326 | A1 | 6/2014 | Terlizzi et al. | |
| 2015/0020832 | A1 | 1/2015 | Greim et al. | |
| 2015/0181942 | A1* | 7/2015 | Holzherr | A24F 47/008 131/328 |
| 2017/0033568 | A1* | 2/2017 | Holzherr | A24F 47/008 |
| 2017/0338609 | A1* | 11/2017 | Holzherr | H01R 29/00 |

* cited by examiner

SYSTEM AND METHOD FOR CONFIGURING ELECTRICAL CONTACTS IN ELECTRICAL DEVICE

The present disclosure relates to a method and system for detecting the orientation of a secondary device electrically connected to a primary device, where the secondary device can connect to the primary device in a plurality of orientations. The invention relates in particular to charging a secondary device from a primary device, and to charging of devices with a plurality of symmetrically disposed electrical contacts that can mate with a charging device in a plurality of different orientations.

BACKGROUND

Portable electronic devices often need to electrically connect to other electrical devices in order to be recharged and in order to exchange data, such as software updates or usage data. Typically data is transferred over one set of electrical contacts and power is transferred over another set of electrical contacts.

In order to ensure that the correct electrical connections are made, so that the data contacts on one device mate with the data contacts on the other device, and similarly the power contacts on one device mate with the power contacts on the other device, prior systems have relied on mechanical means to prevent incorrect connection. This means that the devices can only connect in one orientation, which can be difficult and cause irritation for end users.

BRIEF SUMMARY

It is an object of the invention to allow power and data contacts on two devices to be correctly mated together without requiring mechanical means to force the two devices into one particular orientation relative to one other.

In a first aspect there is provided a system comprising a primary device and a secondary device, the primary device having electrical contact pins configured to engage electrical contacts on the secondary device to allow for the exchange of power and data between the primary and secondary devices, wherein the primary device has n electrical contact pins, where n is a positive integer greater than two, and wherein the primary and secondary devices are constructed so that the electrical contact pins of the primary device can engage the electric contacts of the secondary device in a plurality of different allowed relative orientations, the plurality of allowed relative orientations comprising m distinct electrical orientations, wherein m is a positive integer less than n, and wherein the primary device is configured to determine which of the m electrical orientations the secondary device is in relative to the primary device by comparing voltages measured between at least m different pairs of electrical contacts on the secondary device with a voltage record stored in a memory in the primary device.

The primary device and the secondary device may be constructed so that the number of physically allowed relative orientations is greater than m.

In one embodiment, n is equal to five. The secondary device may also have five electrical contacts. Each of the electrical contacts may span two adjacent sides of a housing of the secondary device. So in the case of five electrical contacts, the secondary device may have a ten sided housing, with each contact spanning two sides of the housing. The five contacts may comprise a power contact, an electrical ground contact, a data transmission contact, a data reception contact, and a redundant contact connected to electrical ground.

The secondary device may have an external housing having a cross section in the shape of a regular polygon with protrusion on at least one side of the polygon. In one embodiment the polygon is a decagon.

The primary device may comprise a socket, wherein the electrical contact pins are provided in the socket and wherein socket is shaped to allow the secondary device into the socket to engage the electrical contact pins in the plurality of allowed relative orientations.

The primary device may comprise a bearing surface outside of the socket, wherein the bearing surface is configured to engage the secondary device and prevent some relative orientations between the pins of the primary device and the contacts of the secondary device. In one embodiment the bearing surface is a surface extending from an edge of the socket having the shape of one half of the socket and is configured to support the secondary device when it is engaged with the socket.

In one embodiment m is equal to three. The plurality of different allowed relative orientations may consist of five allowed relative orientations.

The primary device may comprise a controller configured to apply a current to different pairs of electrical contact pins and comprises a non-volatile memory that stores the voltage record and the controller may be configured to compare measured voltages between the different pairs of electrical contact pins with the voltage record. By using a power source in the primary device and measuring the voltage drop across the plurality of pairs of contact pins to determine the relative orientation of the primary and secondary devices, no power is required from within the secondary device. So the system can operate even if the secondary device has no available power, for example because a battery in the secondary device has become fully discharged.

Any suitable switches may be used, but in one embodiment each of the switches is a transistor.

The primary device may be a charging device configured to charge a secondary battery in the secondary device. The controller in the primary device may be configured to close a plurality of the switches in response to the determined orientation of the secondary device prior to a charging operation. The primary device may further comprise a current limiting resistor connected in parallel with a current limiting switch between a power source and the electrical contacts on the device, wherein the controller is configured to hold the current limiting switch open during the orientation operation. This ensures that only limited current is passed to the secondary device contacts during the orientation operation but that a greater current can be passed to the secondary device during a charging operation.

Advantageously, the secondary device comprises protection diodes connected between a plurality of pairs of contacts on the secondary device.

The secondary device may be an electrically operated smoking device and may be sized to approximate the size of a conventional cigarette. The primary device may be a charger device or an adaptor allowing the secondary device to connect to a further device and exchange power and data with the further device. For example, the primary device may be a USB adaptor for the secondary device.

The secondary device may be an electrically operated smoking system.

In a second aspect, there is provided a method of a configuring electrical contacts in primary device configured to engage with a secondary device, the primary device having electrical contact pins configured to engage electrical contacts on the secondary device to allow for the exchange of power and data between the primary and secondary devices, wherein the primary device has n electrical contact pins, where n is a positive integer greater than two, wherein the primary device has a plurality of switches allowing different contact pins to be connected to a measuring component within the primary device and to electrical ground and wherein the primary and secondary devices are constructed so that the electrical contact pins of the primary device can engage the electric contacts of the secondary device in a plurality of different allowed relative orientations, the plurality of relative orientations comprising m distinct electrical orientations, wherein m is a positive integer less than n, comprising, when the secondary device is engaged with the primary device: sequentially closing different pairs of switches from the plurality of switches to connect at least m different pairs of electrical contacts on the secondary device to the measuring component in the primary device, and comparing voltages measured by the measuring component with a voltage record stored in a memory in the primary device.

The step of closing different pairs of switches from the plurality of switches may connect a power supply in the primary device to different contacts on the secondary device.

The controller may be configured to close a plurality of the switches in response to the determined orientation of the secondary device. In this way the functions of the electrical contacts in the primary device can be configured to match the function of the electrical contacts of the secondary device depending on the orientation of the secondary device.

Any feature relating to one aspect may be applied to other aspects, in any appropriate combination. In particular, method aspects may be applied to apparatus aspects, and vice versa. Furthermore, any, some or all features in one aspect can be applied to any, some or all features in any other aspect, in any appropriate combination.

It should also be appreciated that particular combinations of the various features described and defined in any aspects of the invention can be implemented or supplied or used independently.

BRIEF DESCRIPTION OF THE DRAWINGS

These and other aspects of the apparatus will become apparent from the following exemplary embodiments that are described with reference to the following figures in which.

DETAILED DESCRIPTION

Figure 1:
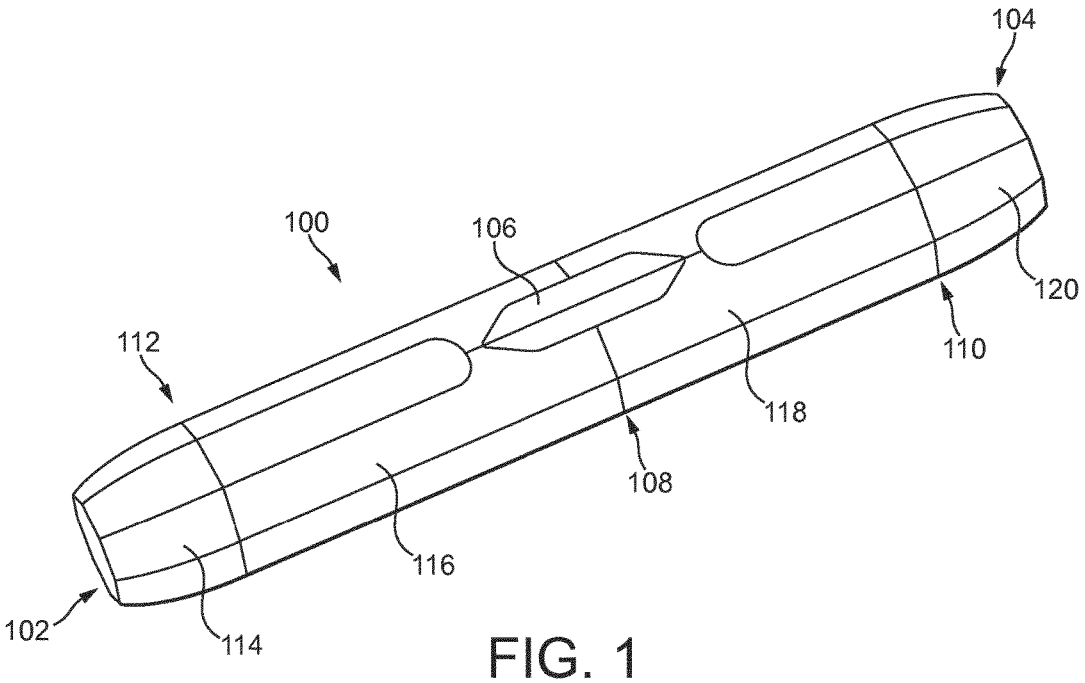
FIG. 1 is a perspective illustration of an exemplary secondary device.

FIG. 1 shows a perspective view of one embodiment of a secondary device 100. The secondary device 100 in this example is an electrically heated aerosol-generating device adapted to receive a smoking article comprising an aerosol-forming substrate. The device 102 is elongate and comprises two opposed polygonal end faces 102 and 104 respectively. As can be seen, the outer housing of the device 100 comprises four portions joined at the coupling lines 108, 110 and 112 respectively. The four portions respectively are a first tapered end portion 114 attached to a first central portion 116, a second tapered end portion 120 attached to a second central portion 118. A button 106 is provided on the housing in a protruding portion, which as a keying feature limiting the number of possible orientations in which the secondary device can engage the primary device.

Figure 2:
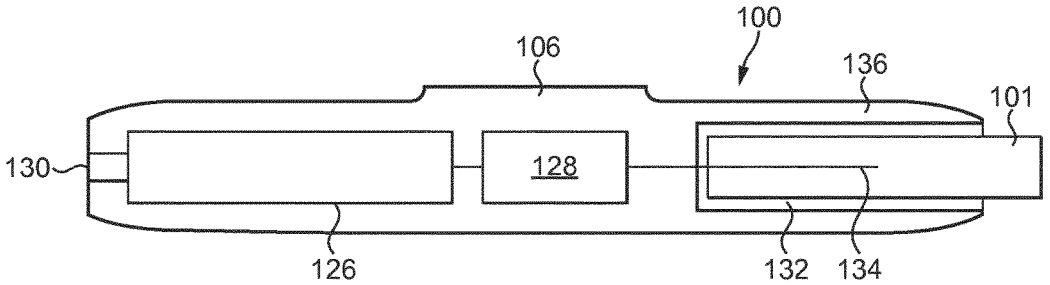
FIG. 2 is schematic illustration of the secondary device of FIG. 1.

The secondary device is illustrated schematically in FIG. 2. The secondary device 102 comprises a rechargeable battery 126, secondary control electronics 128 and electrical contacts 130. As described above, the rechargeable battery 126 of the secondary device 102 is configured to receive a supply of power from the primary battery 106 when the electrical contacts 130 are in contact with the electrical contacts 110 of the primary device 100 and the lid is in the closed position. The secondary device 102 further comprises a cavity 132 configured to receive the aerosol generating article 101. A heater 134, in the form of, for example, a blade heater, is provided at the bottom of the cavity 132. In use, the user activates the secondary device 102, and power is provided from the battery 126 via the control electronics 128 to the heater 134. The heater is heated to a standard operational temperature that is sufficient to generate an aerosol from the aerosol-forming substrate of the aerosol-generating article 104. The components of the secondary device 102 are housed within the housing 136. Button 106 is also illustrated in FIG. 2.

Figure 4A:
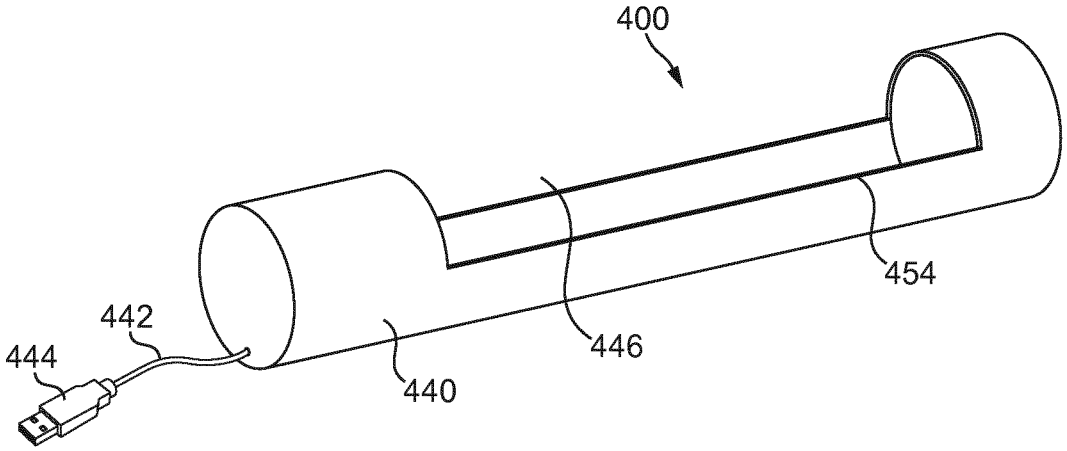
FIG. 4*a* is a perspective view of an exemplary primary device.

FIG. 4*a* shows a primary device 400. The primary device 400 in this example is a charging unit for a secondary device of the type illustrated in FIGS. 1 and 2. The primary device 400 is a USB charging device configured to connect to the USB port of a personal computer. The primary device comprises a USB connector 444 connected to the housing 440 of the primary device by a cable 442. Power is supplied to the primary device through the USB connection. The primary device comprises, a charger circuit, control electronics, and electrical contacts configured to provide electrical power to the secondary device, from the charger circuit, when the secondary device is in connection with the electrical contacts, as will be described.

Figure 4B:
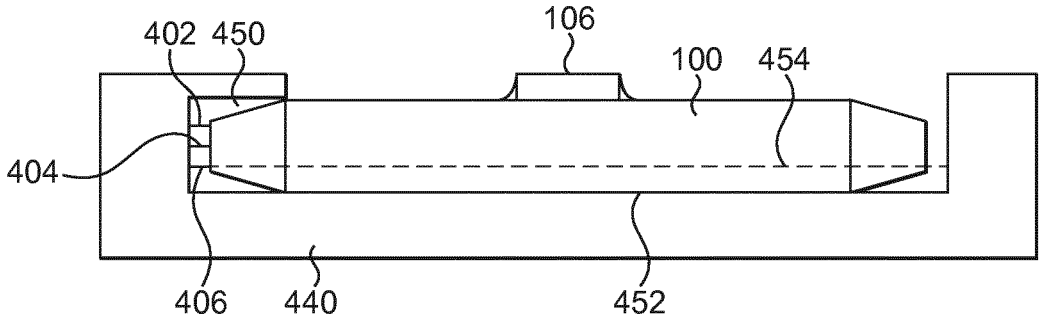
FIG. 4*b* is a schematic illustration of the primary device of FIG. 4*a* coupled to a secondary device.

FIG. 4*b* shows a cross section of the primary device with a secondary device engaged with it. As can be seen, the electrical contact pins 402, 404, 406 on the primary device are provided within a socket 450. The socket 450, together with opening 446, is configured to receive the secondary device 100. A bearing surface 452 supports the secondary device. The bearing surface is shaped to correspond with half of the surface of the secondary device or one half of the socket, i.e. half of a decagon. The upper extent of the bearing surface is indicated by dotted line 454. When the secondary device is electrically engaged with the primary device, a flat surface of the housing of the secondary device rests on the bearing surface 452. But the interaction of the bearing surface 452 on the primary device and the button 106 on the secondary device prevents the secondary device from engaging with the electrical contact pins in some orientations.

The primary device is configured to supply power to the secondary device, and to exchange data with the secondary device through the contact pins. The data connection is configured to download data from the secondary device such as usage statistics, operational status information and the like. In addition, the data connection is configured to upload data from the primary device to the secondary device such as operating protocols. The operating protocols may include power supply profiles to be used when supplying power from the secondary power supply to the heater. Data may be communicated from the secondary device 100 to the primary device 400 and stored in, for example, control electronics in the primary device. Data may then be communicated out of the primary device 400 via the USB connector. The primary device can be switched between different configurations such that contact pins in the primary device perform different functions in different configurations, as will be described.

Figure 3A:
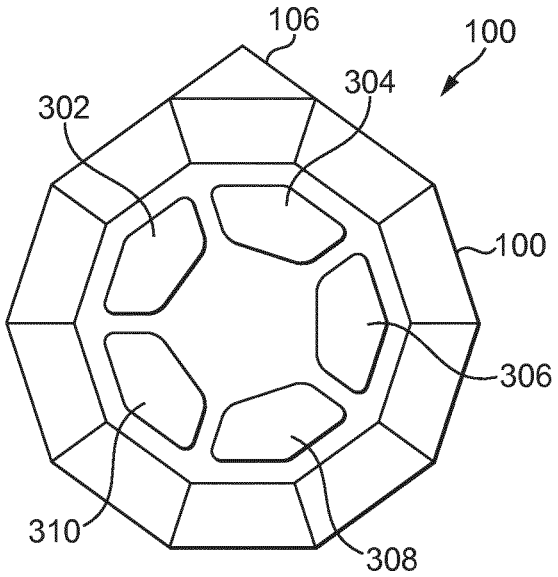
FIG. 3*a* is an illustration of the layout of the electrical contacts on an end face of the secondary device of FIG. 2.

FIG. 3*a* shows the polygonal end face 102 of the secondary device 100. As can be seen, the polygon in this embodiment is a decagon. The button 106 protrudes beyond the basic decagonal shape. FIG. 3*a* shows that the end face 102 has five electrical contacts 302, 304, 306, 308 and 310, each spanning two adjacent sides of the decagonal housing. The electrical contacts are disposed in a rotationally symmetric pattern about a central axis of the secondary device. The electrical contacts are adapted to connect with the contact pins in the primary charging device 400. Contact 302 is the power input contact, contact 304 is an electrical ground contact, contact 306 is a data transmission contact, contact 308 is a redundant contact also connected to electrical ground and contact 310 is a data reception contact.

Figure 3B:
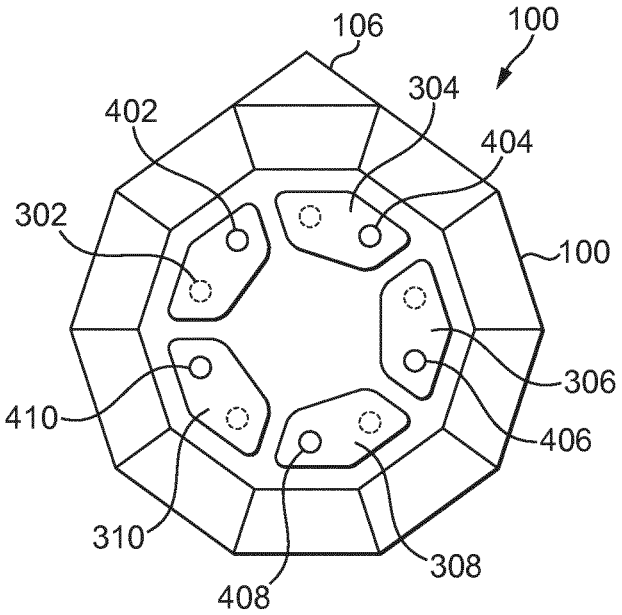
FIG. 3*b* is an illustration of the layout of the electrical contacts on the primary device of FIG. 1 overlaid on the illustration of FIG. 3*a;*

FIG. 3*b* shows the end face of the secondary device with the position of the electrical contact pins of the primary device superimposed. There are five pins 402, 404, 406, 408, 410 corresponding to the five electrical contacts on the secondary device. It can be seen that each of the pins is in contact with a different electrical contact on the secondary device. FIG. 3*b* also shows in dotted outline another possible position for the pins on the contacts of the secondary device, rotated 36 degrees anticlockwise relative to the position of the pins shown in solid outline. It can be seen that the two positions illustrated are mechanically different but electrically identical.

The primary device is constructed to allow each of the five pins to be connected to each of: the power output from the charging system, electrical ground, and the data reception and data transmission ports of the CPU in the primary device, depending on the orientation of the secondary device in the primary device. The end user can insert the secondary device into the socket in the primary device in any mechanically possible orientation without needing to worry about the correct electrical configuration.

Figure 5:
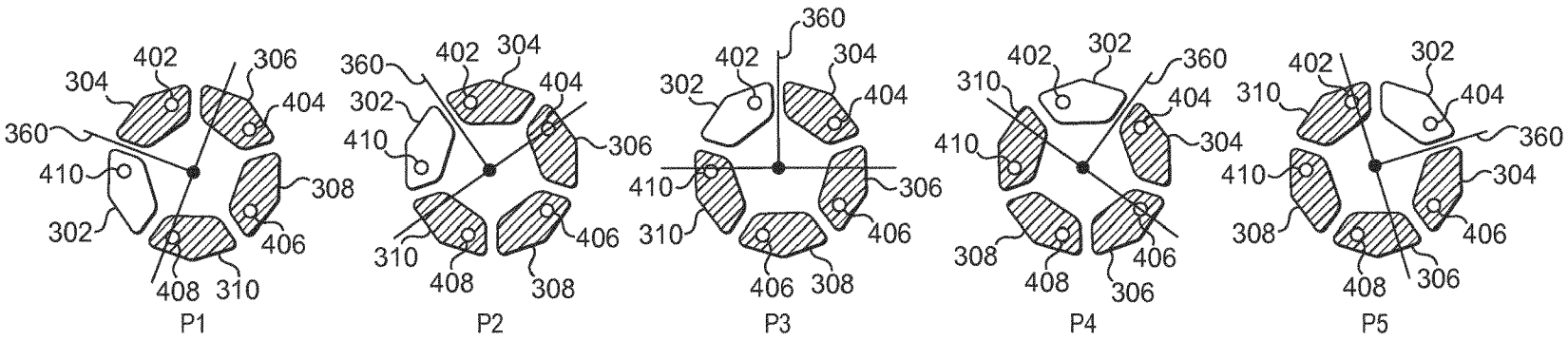
FIG. 5 is a schematic illustration of the allowed orientations of the secondary device relative to the primary device.

In this example there are five mechanically allowed orientations, labelled P1, P2, P3, P4 and P5, because five orientations are prevented by the interaction of the button and the bearing surface. FIG. 5 illustrates the allowed orientations. Each of the electrical contacts 302, 304, 306, 308, 310 is shown and line 360 represents the position of the button. The button cannot be below the horizontal because in those positions it would interfere with the bearing surface. The position of each of the contact pins 402, 404, 406, 408 and 410 on the primary device is shown for each configuration.

It can be seen that the five mechanically allowed orientations comprise only three distinct electrical configurations. Electrically P1 is equivalent to P2, and P3 is equivalent to P4. Accordingly the primary device needs to be able to switch between three different electrical configurations.

In order to configure the pins in the primary device correctly, the primary device must first be able to determine which of the three possible electrical configurations the orientation of the secondary device corresponds to. It can also be seen that in all five configurations one of pin 406 or 408 is connected to one of the ground contacts 308 or 304 and that the power contact 302 is always connected to one of pins 410, 402 and 404.

Figure 6:
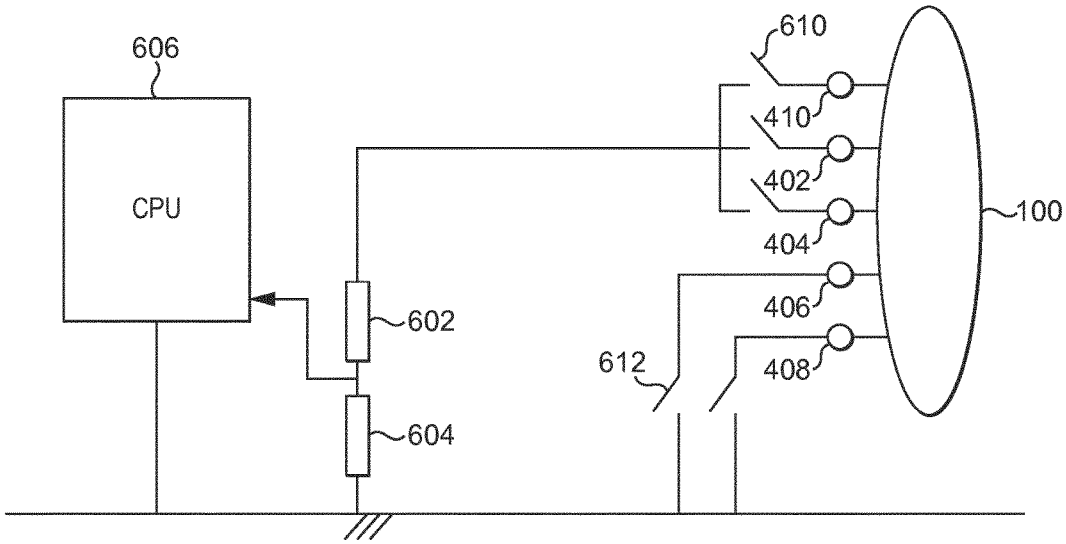
FIG. 6 is an illustration of a first arrangement for determining the orientation of the secondary device.

FIG. 6 illustrates a first arrangement that allows the primary device to determine the orientation of the secondary device. In this first arrangement, the voltage from a battery in the secondary device is detected. FIG. 6 is a schematic illustration of the contact pins 402, 404, 406, 408, 410 on the primary device connected to the contacts on the secondary device 100. Contacts 410, 402 and 404, to which the power input line to the battery in the secondary device is connected are each connected to a voltage divider by a switch 610. The voltage divider comprises resistors 602 and 604. The CPU 606 in the primary device is configured to read the voltage between the two resistors. Contact pins 406 and 408 are connected to ground through switches 612. In this embodiment switch 610 and 612 are transistors which are controlled by the CPU 606.

The orientation detection process proceeds to determine which of pins 410, 402 and 404 is connected to the battery of the secondary device. In a first stage, S1, it is assumed that the secondary device is in orientation P1 or P2 so that the switches associated with contact pins 410 and 406 are closed. The voltage from the voltage divider is then recorded. Then in stage S2 orientation P3 or P4 is assumed and the switches associated with pins 402 and 408 are closed and the voltage at the voltage divider recorded. Finally in stage S3 orientation P5 is assumed and the switches associated with pins 404 and 406 are closed and the voltage at the voltage divider recorded. The recorded voltages are compared with a threshold value and as a result of the comparison given either a high value or 1 or a low value of 0. Table 1 below shows the resulting voltages depending on the actual orientation of the secondary device.

TABLE 1

| Actual orientation | S1 value | S2 value | S3 value |
|---|---|---|---|
| P1 or P2 | 1 | 0 | 0 |
| P3 or P4 | 0 | 1 | 0 |
| P5 | 0 | 0 | 1 |

It can be seen that each distinct electrical configuration corresponding to a particular orientation or orientations of the secondary device relative to the primary device has a unique result from stage S1, S2 and S3. The CPU can compare the recorded result with a database stored in memory to deduce the correct electrical configuration for the electrical contact pins.

Figure 7:
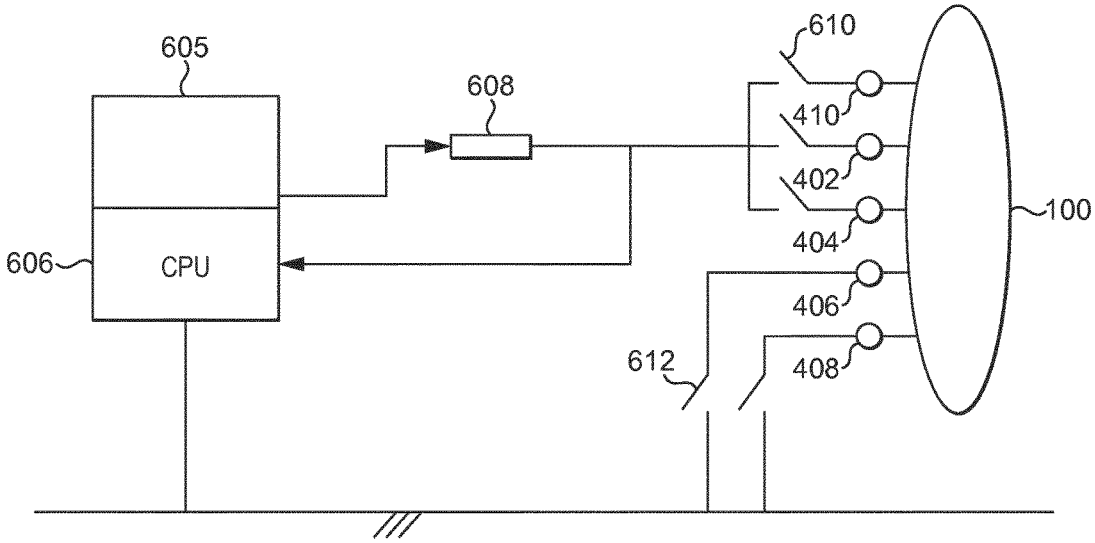
FIG. 7 is an illustration of a second arrangement for determining the orientation of the secondary device and FIG. 8 illustrates an arrangement of switches within the primary device.

Before describing how the primary device configures the electrical contact pins, and alternative orientation detection method will be described with reference to FIG. 7. In this example, because the primary device is a charger, it is possible that the secondary device will have no power. So it is advantageous if the detection orientation process uses a power source in the primary device rather than a power source in the secondary device to perform detection. In the system shown in FIG. 7, it is the position of the ground contacts on the secondary device that are detected.

The voltage source 605 in the primary device is connected, through a resistor 608, to each of contacts pins 410, 402 and 404, through respective switches 610. Contact pins 406 and 408 are connected to ground through respective switches 612. Switches 610 and 612 are transistors controlled by CPU 606. The CPU is configured to measure the voltage at each of pins 410, 402 and 404 when they are connected to the voltage source 605. Again the voltages are compared to a low threshold to give them a binary value. When the output voltage is zero the CPU must be connected to a ground contact on the secondary device As before pairs of switches are closed in sequence to provide a voltage sequence recorded by the CPU. The voltage sequence recorded is compared with sequence data stored in memory to allow the orientation of the secondary device relative to the primary device to be deduced.

As before the switches are switched according to stages S1, S2 and S3. Table 2 shows the resulting values recorded by the CPU.

TABLE 2

| Actual orientation | S1 value | S2 value | S3 value |
|---|---|---|---|
| P1 or P2 | 1 | 0 | 1 |
| P3 or P4 | 1 | 1 | 0 |
| P5 | 0 | 1 | 1 |

Again it can be seen that each of the electrically distinct relative orientations between the primary and secondary devices provides a unique voltage sequence.

Figure 8:
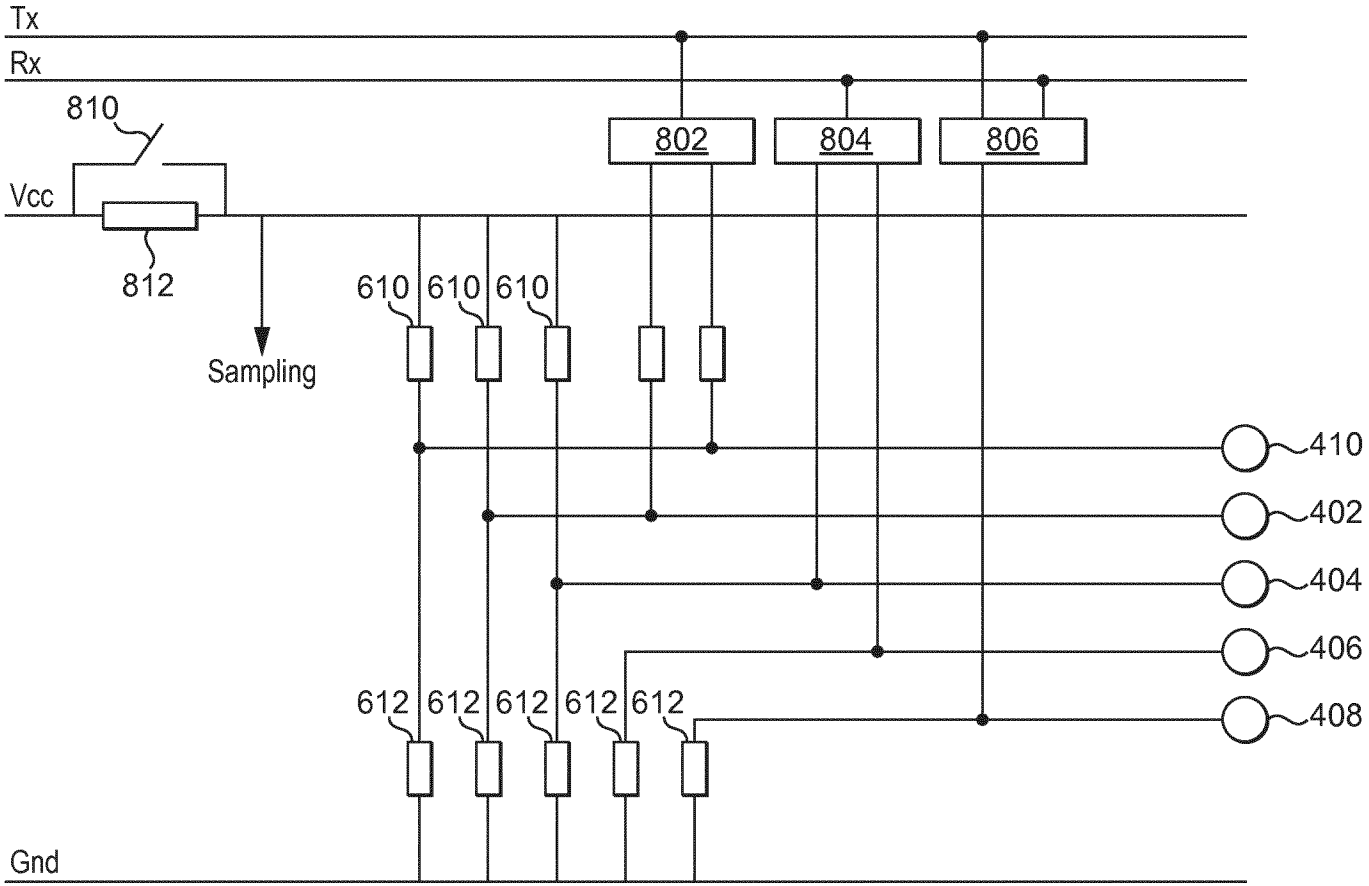

Once the orientation of the secondary device relative to the primary device is known, the primary device must then configure to contact pins to connect them to the correct function within the primary device. FIG. 8 is a simplified diagram showing the arrangement of switches in the primary device that allows the correct configuration to be achieved.

The power source, indicated by Vcc, may need to connect pins 40, 402 and 404 depending on the orientation of the secondary device. Accordingly switches 610 are provided to selectively connect the Vcc to one of these pins. All of the pins 402, 404, 406, 408 and 410 may need to be able to connect to electrical ground depending on the orientation of the secondary device. Accordingly switches 612 are provided between ach of the pins and electrical ground. The data transmission line, indicated by Tx may need to connect to pin 410, 402 or 408. The data receiving line Rx may need to connect to pin 404, 406 or 408. A first tri-state switch 802 is provided to selectively connect Tx to pin 410 or 402 or neither. A second tri-state switch 804 is provided to connect Rx to pin 404 or 406. A third tri-state switch 806 is also provided to connect pin 408 to Tx or Rx or neither.

In this example each of the switches 610 and 612 is a MOSFET. Operation of each switch is controlled by CPU in the primary device. The primary device may store the correct configuration of switches 610, 612, 802, 804 and 806 for each determined orientation of the secondary device in a non-volatile memory. The CPU can then simply look up the switch configuration from the memory and control the switches accordingly.

A current limiting resistor 810 is also provided to ensure that only limited current is used in the orientation detection process. A shorting switch 812, which is also a transistor, is provided for shorting out the current limiting resistor during a charging process. The shorting switch is also controlled by the CPU.

The described embodiment is just one example of many possible embodiments that could implement the invention. It is of course to be understood that the specification is not intended to be restricted to the details of the above embodiments which are described by way of example only. Although the invention has been described in relation to an electrically heated smoking system comprising a smoking device and a charging device, it should be clear that any primary and secondary devices that exchange power and data over different electrical contacts could be used to implement the invention.

The invention claimed is:

1. A system, comprising:

a primary device and a secondary device, the primary device having n electrical contact pins, where n is a positive integer greater than two, configured to engage electrical contacts on the secondary device to allow for exchange of power and data between the primary and secondary devices, the primary and secondary devices being constructed such that the electrical contact pins of the primary device are engageable with the electrical contacts of the secondary device in a plurality of different relative orientations comprising m distinct electrical orientations, where m is a positive integer greater than one but less than n, the primary device comprising a controller and switches configured to allow different contact pins to be connected to the controller, and the controller being configured to apply a current to different pairs of electrical contact pins and comprising a non-volatile memory configured to store a voltage record, to compare measured voltages between the different pairs of electrical contact pins with the voltage record to determine which of the m distinct electrical orientations the secondary device is in relative to the primary device, and to close a plurality of the switches in response to a determined orientation of the secondary device.

2. The system according to claim 1, wherein the primary device and the secondary device are constructed such that a number of physically allowed relative orientations is greater than m.

3. The system according to claim 1, wherein n is equal to five.

4. The system according to claim 1, wherein the secondary device has five electrical contacts.

5. The system according to claim 4, wherein the five electrical contacts comprise a power contact, an electrical ground contact, a data transmission contact, a data reception contact, and a redundant contact connected to electrical ground.

6. The system according to claim 1, wherein the secondary device has an external housing having a cross section in a shape of a regular polygon with a protrusion on at least one side of the polygon.

7. The system according to claim 6, wherein the polygon is a decagon.

8. The system according to claim 1, wherein the primary device comprises a socket, wherein the electrical contact pins are provided in the socket, and wherein the socket is shaped to allow the secondary device into the socket to engage the electrical contact pins in the plurality of different relative orientations.

9. The system according to claim 8, wherein the primary device comprises a bearing surface outside of the socket, and wherein the bearing surface is configured to engage the secondary device and to prevent some relative orientations of the plurality of different relative orientations between the electrical contact pins of the primary device and the electrical contacts of the secondary device.

10. The system according to claim 1, wherein n is greater than three and m is equal to three.

11. The system according to claim 1, wherein the plurality of different relative orientations consists of five allowed relative orientations.

12. The system according to claim 1, wherein the primary device further comprises a current limiting resistor connected in parallel with a current limiting switch between a power source and the electrical contacts on the secondary device, and wherein the controller is further configured to hold the current limiting switch open during an orientation determination operation.

13. The system according to claim 1, wherein the primary device is a charging device configured to charge a secondary battery in the secondary device.

14. The system according to claim 1, wherein the secondary device is an electrically operated smoking system.

15. A method of configuring electrical contacts in primary device configured to engage with a secondary device, the primary device having n electrical contact pins, where n is a positive integer greater than two, configured to engage electrical contacts on the secondary device to allow for exchange of power and data between the primary and secondary devices, the primary device comprising a controller and switches allowing different contact pins to be connected to a measuring component within the primary device and to electrical ground, the primary and secondary devices being constructed such that the electrical contact pins of the primary device are engageable with the electrical contacts of the secondary device in a plurality of different relative orientations comprising m distinct electrical orientations, where m is a positive integer greater than one but less than n, the controller being configured to apply a current to different pairs of electrical contact pins and comprising a non-volatile memory configured to store a voltage record, to compare measured voltages between the different pairs of electrical contact pins with the voltage record to determine which of the m distinct electrical orientations the secondary device is in relative to the primary device, and to close a plurality of the switches in response to a determined orientation of the secondary device, and the method comprising, when the secondary device is engaged with the primary device, sequentially closing different pairs of switches from the plurality of switches to connect at least m different pairs of electrical contacts on the secondary device to the measuring component within the primary device, and comparing voltages measured by the measuring component with a voltage record stored in a memory in the primary device.

* * * * *